US009820586B1

(12) United States Patent
Goppion

(10) Patent No.: US 9,820,586 B1
(45) Date of Patent: Nov. 21, 2017

(54) MUSEUM SHOWCASE WITH AN ARTICULATED QUADRILATERAL HINGE, HAVING A HOOK FOR HOLDING IT IN A CLOSED POSITION

(71) Applicant: GOPPION S.P.A., Trezzano Sul Naviglio (IT)

(72) Inventor: Alessandro Goppion, Milan (IT)

(73) Assignee: GOPPION S.P.A., Trezzano Sul Naviglio (IT)

( * ) Notice: Subject to any disclaimer, the term of this patent is extended or adjusted under 35 U.S.C. 154(b) by 0 days.

(21) Appl. No.: 15/228,503

(22) Filed: Aug. 4, 2016

(30) Foreign Application Priority Data

Jul. 22, 2016 (IT) ..... UA2016A5427

(51) Int. Cl.
*A47F 3/00* (2006.01)
*A47F 3/12* (2006.01)
(Continued)

(52) U.S. Cl.
CPC ..... *A47F 3/125* (2013.01); *A47F 3/005* (2013.01); *E05D 3/14* (2013.01); *E05D 11/1021* (2013.01); *E05Y 2900/202* (2013.01)

(58) Field of Classification Search
CPC .. A47F 3/00; A47F 3/005; A47F 3/125; A47F 2003/008; E05Y 2900/202;
(Continued)

(56) References Cited

U.S. PATENT DOCUMENTS 4,063,330 A * 12/1977 Triplette ..... E05D 11/1014 16/321
5,392,493 A * 2/1995 Youngdale ..... E05D 7/04 16/237
(Continued)

FOREIGN PATENT DOCUMENTS

DE 2330228 A1 1/1975
DE 29718056 U1 11/1997
GB 2221721 A 2/1990

OTHER PUBLICATIONS

Italian Search Report and Written Opinion for Italian application IT201600077393 filed Jul. 22, 2016 on behalf of Goppion S.P.A. (English translation of Re Item V of the Written Opinion) dated Feb. 22, 2017. 7 pages.

*Primary Examiner* — Daniel J Rohrhoff
(74) *Attorney, Agent, or Firm* — Steinfl + Bruno LLP

(57) ABSTRACT

The showcase has a hinge comprising a fixed element, associated with the container body, a mobile element, intended to be associated with the door, and a first connecting rod and a second connecting rod hinged between the fixed element and the mobile element, so as to obtain an articulated quadrilateral adapted for causing a roto-translation of the fixed element with respect to the mobile element between an open position and a closed position of the hinge. The hinge also comprises a hook, associated with one from the fixed element and the mobile element and adapted for cooperating in a releasable manner with engagement means associated with the other from the fixed element and the
(Continued)

mobile element, so as to counteract the movement of the mobile element away from the fixed element when the hinge is in closed position.

12 Claims, 6 Drawing Sheets

(51) Int. Cl.
*E05D 3/14* (2006.01)
*E05D 11/10* (2006.01)

(58) Field of Classification Search
CPC ..... E05D 3/14; E05D 3/142; E05D 11/10; E05D 11/1014; E05D 11/1021
See application file for complete search history.

(56) References Cited

U.S. PATENT DOCUMENTS 5,471,709 A * 12/1995 Lanzani ..... A47L 15/4261 16/238
7,814,617 B2 * 10/2010 Frank ..... E05D 3/16 16/286
7,814,621 B1 * 10/2010 Radke ..... E05D 11/1014 16/230
2008/0088210 A1 * 4/2008 Lerman ..... A47F 3/001 312/139.1
2010/0269293 A1 * 10/2010 Wisniewski ..... E05D 3/14 16/250
2011/0089801 A1 * 4/2011 Bonomie ..... E05D 3/14 312/405
2012/0042474 A1 * 2/2012 Kachtan ..... E05C 17/025 16/350
2013/0212835 A1 * 8/2013 Lanzani ..... E05D 3/14 16/287
2013/0221825 A1 * 8/2013 Bonomie ..... E05F 3/20 312/405
2014/0319979 A1 * 10/2014 Goppion ..... A47F 3/002 312/138.1
2015/0167366 A1 * 6/2015 Armstrong ..... E05D 3/142 16/370
2016/0000236 A1 * 1/2016 Goppion ..... E05D 15/46 312/138.1
2016/0000237 A1 * 1/2016 Goppion ..... E05D 15/32 312/109
2016/0106233 A1 * 4/2016 Mitchell ..... A47F 3/005 312/138.1
2016/0362926 A1 * 12/2016 Dey ..... E05F 5/10

* cited by examiner

MUSEUM SHOWCASE WITH AN ARTICULATED QUADRILATERAL HINGE, HAVING A HOOK FOR HOLDING IT IN A CLOSED POSITION

CROSS REFERENCE TO RELATED APPLICATIONS

The present application claims priority to Italian Application No. UA2016A005427 filed on Jul. 22, 2016, which is incorporated herein by reference in its entirety.

FIELD

The present invention concerns, in general, a museum showcase having an articulated quadrilateral hinge, in particular for a large sized door. More specifically, the object of the invention is a museum showcase with an articulated quadrilateral hinge having a hook for holding the door in closed position.

BACKGROUND

The term "museum showcase" is meant to indicate a showcase intended to be arranged in a display room such as a museum, an exhibition or similar and intended for conserving and displaying items of cultural heritage, such as works of art, historical artefacts and similar, in a protected environment. Hereinafter, sometimes for the sake of brevity just the term showcase will be used, by this in any case still meaning a museum showcase.

Here and hereinafter the term "protected environment" is meant to indicate an environment in which the atmosphere is controlled, by monitoring one or more parameters including temperature, humidity, dust content, pollutant content, in order to maintain the foreseen conservation conditions of the displayed objects, and wherein the possibility of access for unauthorised people is prevented to avoid thefts and damage to the displayed objects.

Here and hereinafter the term "door" is meant to indicate both an openable wall of a museum showcase, and a more complex openable structure, for example a case, formed from walls fixedly connected to one another so as to form a single piece.

Museum showcases with doors supported by articulated quadrilateral hinges are known and widely used in the market, said hinges comprising a fixed element anchored to a container body of the showcase, a mobile element anchored to the door and a pair of connecting rods hinged, respectively, to the fixed element and to the mobile element.

In this way, the door is articulated to the container body and moveable with respect to it, according to a roto-translation movement, between a closed position, in which it abuts on the container body, and an open position, in which it is angled with respect to the container body so as to allow access to the inside of the container body.

A drawback of known articulated quadrilateral hinges is linked to the problems encountered when it is wished to move a particularly large and heavy door (for example having width and height dimensions of a few meters).

Indeed, it has been observed that, with this type of hinge, large sized doors, when they are in closed position, due to the geometry of the quadrilateral linkage, can tend to move away from the container body under the effect of their own weight or in the presence of pushes from somebody.

This movement of the door away from the container body in closed position has been observed particularly in doors of showcases for displaying and/or conserving valuable objects, such as works of art, scientific artefacts, objects of cultural heritage and the like. Indeed, in order to protect the work from attempted theft or damage, the aforementioned showcases are normally made of shatterproof and/or bullet-proof glass, which further increases the weight thereof.

The problem outlined above relative to known articulated quadrilateral hinges is particularly serious in the case of the aforementioned showcases, in which, in order to preserve the work of art, it is important to completely insulate the interior from the exterior, whereas the movement apart of the door and the container body can be such as to create an opening through which contaminating agents, for example dust, humidity and the like, can enter into the container body. Indeed, the away movement of the door can even provide a grip for possible those with malicious intent who wish to force open the showcase.

Moreover, in extreme conditions, the movement of the door away from the container body could generate undesired stresses on the components of the hinge, possibly compromising the structural and functional characteristics thereof. In this case, the hinge must be replaced.

The problem at the basis of the present invention is, therefore, to provide a museum showcase with an articulated quadrilateral hinge capable of overcoming the aforementioned drawbacks with reference to the prior art, i.e. configured so as to counteract the movement of the door away from the container body in closed position, thus ensuring perfect closure of the showcase.

SUMMARY

Consequently, the invention concerns a museum showcase according to claim 1. Preferred characteristics are then given in the dependent claims.

In particular, a museum showcase according to the invention includes a container body, an openable door that closes the container body and at least one hinge, which hinge comprises a fixed element, associated with the container body, a mobile element, associated with the door, a first connecting rod and a second connecting rod hinged between the fixed element and the mobile element, so as to obtain an articulated quadrilateral adapted for causing a roto-translation of the mobile element with respect to the fixed element between an open position and a closed position. The showcase is characterised in that the hinge comprises a hook, associated with one from the fixed element and the mobile element and adapted for releasably cooperating with engagement means associated with the other from the fixed element and the mobile element, so as to counteract the movement of the mobile element away from the fixed element when the hinge is in closed position.

In this showcase, the problem outlined above is solved by the hook, which, by cooperating with the engagement means, keeps the hinge, and therefore the door on which the hinge is mounted, in closed position, advantageously preventing the door from moving away from the container body.

In a preferred embodiment, the hook extends from the mobile element and the releasable engagement means comprise a roller fixed to the fixed element. This advantageously facilitates the coupling between the hook and the roller.

Preferably, the roller is housed in a longitudinal cavity formed in an end portion of the fixed element; the hook, in closed position of the hinge, is housed in such a longitudinal cavity. As a result, advantageously, there is greater stability of coupling between roller and hook.

Preferably, the hook is formed in a single body with the mobile element.

Preferably, the first connecting rod and the second connecting rod have a rounded head by which they are hinged to the mobile element and a substantially semi-circular seat close to the rounded head.

Preferably, the seat of the first connecting rod faces towards the second connecting rod and is adapted for housing the head of the second connecting rod, in completely open position of the hinge. This advantageously makes it possible to maximise the opening angle of the door.

Preferably, the seat of the second connecting rod faces towards the first connecting rod and is adapted for housing the head of the first connecting rod, in closed position of the hinge. This advantageously reduces the packing hinge size in closed position.

In a preferred embodiment of the invention, the fixed element has a cavity, from which a wall projects upwards, hinged to the first connecting rod and to the second connecting rod.

Preferably, the mobile element comprises a plate, from which a wall extends, hinged to the first connecting rod and to the second connecting rod, the hook extending from such a wall, preferably in a single body with it.

Preferably, the first connecting rod and the second connecting rod each comprise a pair of rods, whose feet are hinged to the wall of the fixed element, on the opposite side with respect to it, and the heads of which are hinged to the wall of the mobile element, on the opposite side with respect to it. Such a configuration of the connecting rods advantageously gives greater stability and compactness to the hinge during the roto-translation movement.

In an alternative embodiment of the invention, the fixed element has a cavity, from which two parallel and spaced walls for hinging the first connecting rod and the second connecting rod rise up.

Preferably, the mobile element comprises a plate, from which two parallel and spaced walls projects upwards, hinged to the first connecting rod and to the second connecting rod, the hook extending from such walls.

Preferably, the first connecting rod and the second connecting rod each comprise a rod, whose feet are hinged to the walls of the fixed element, between them, and the heads of which are hinged to the walls of the mobile element, between them. This configuration of the connecting rods also advantageously gives excellent stability and compactness to the hinge during the roto-translation movement.

BRIEF DESCRIPTION OF DRAWINGS

Further characteristics and advantages of a hinge according to the invention will become clearer from the following description of preferred embodiments thereof, made with reference to the attached drawings. In such drawings.

DESCRIPTION

Figure 1:
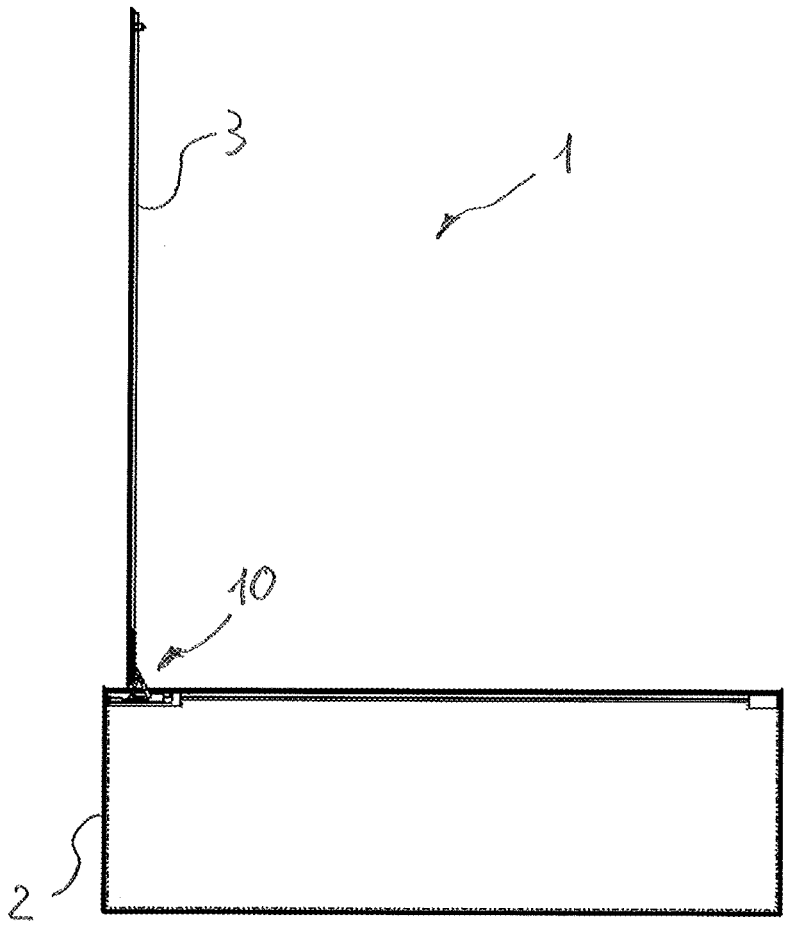
FIG. 1 is a schematic plan view from above of a showcase according to the invention.

With particular reference to FIG. 1, a showcase according to the invention is wholly indicated with reference numeral 1. The showcase 1 comprises a container body 2 and an openable door 3, mounted on the container body 2 by means of at least one hinge 10; normally, two or more hinges 10 will be provided, even if in the figures only one is visible.

Figure 2:
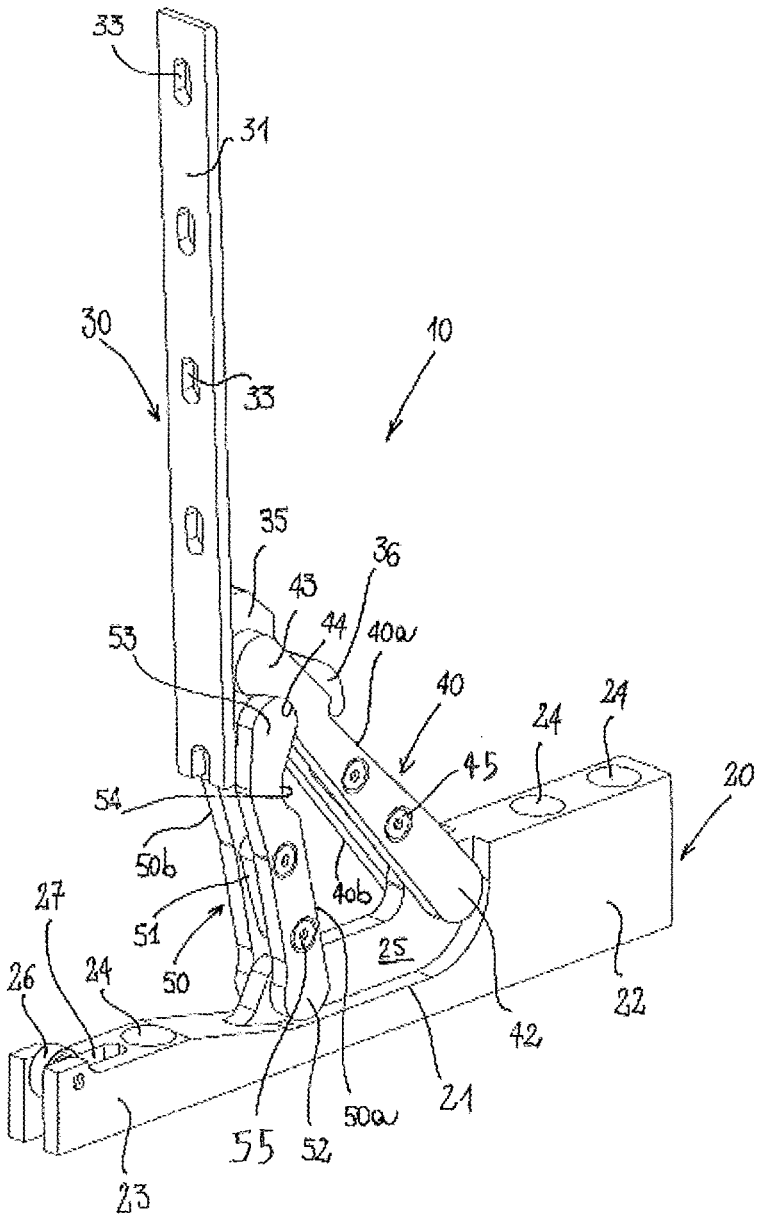
FIG. 2 is a perspective view of the hinge of the showcase of FIG. 1, according to a first embodiment of the invention, shown in completely open position.
Figure 3:
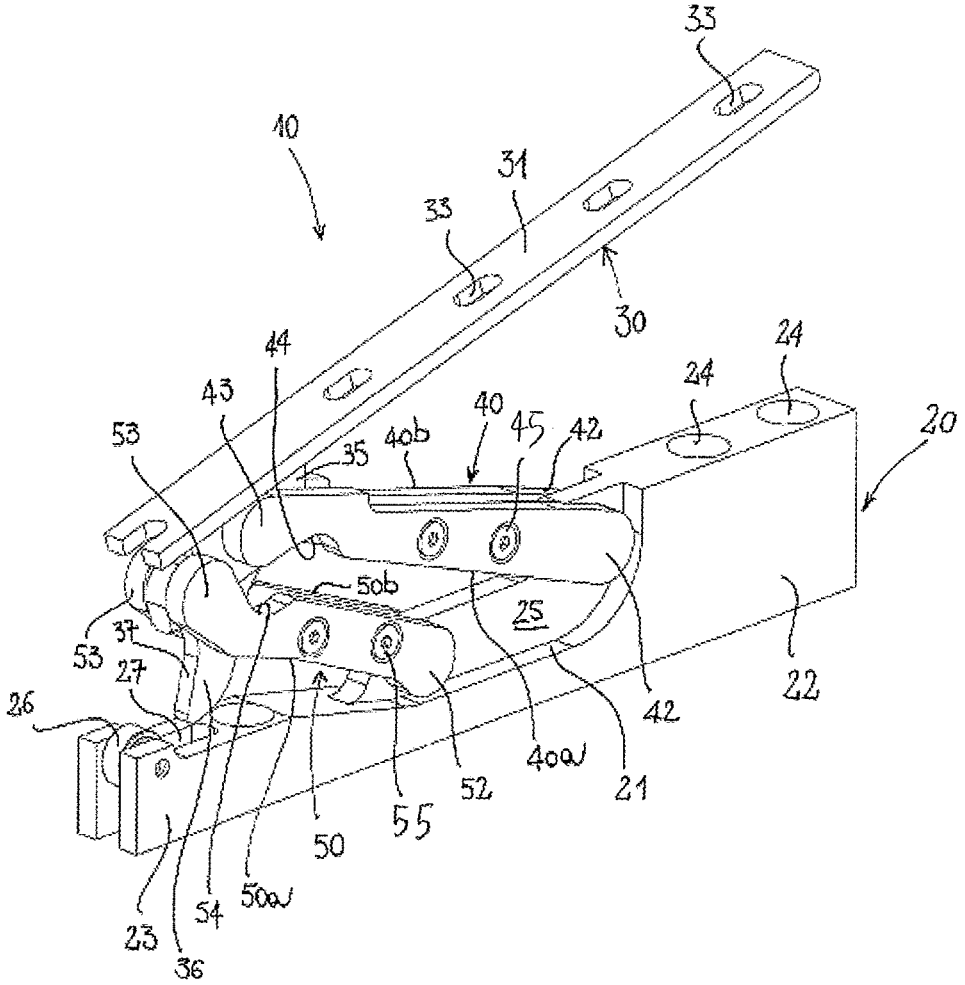
FIG. 3 is a perspective view of the hinge of FIG. 2, shown in partially open position.
Figure 4:
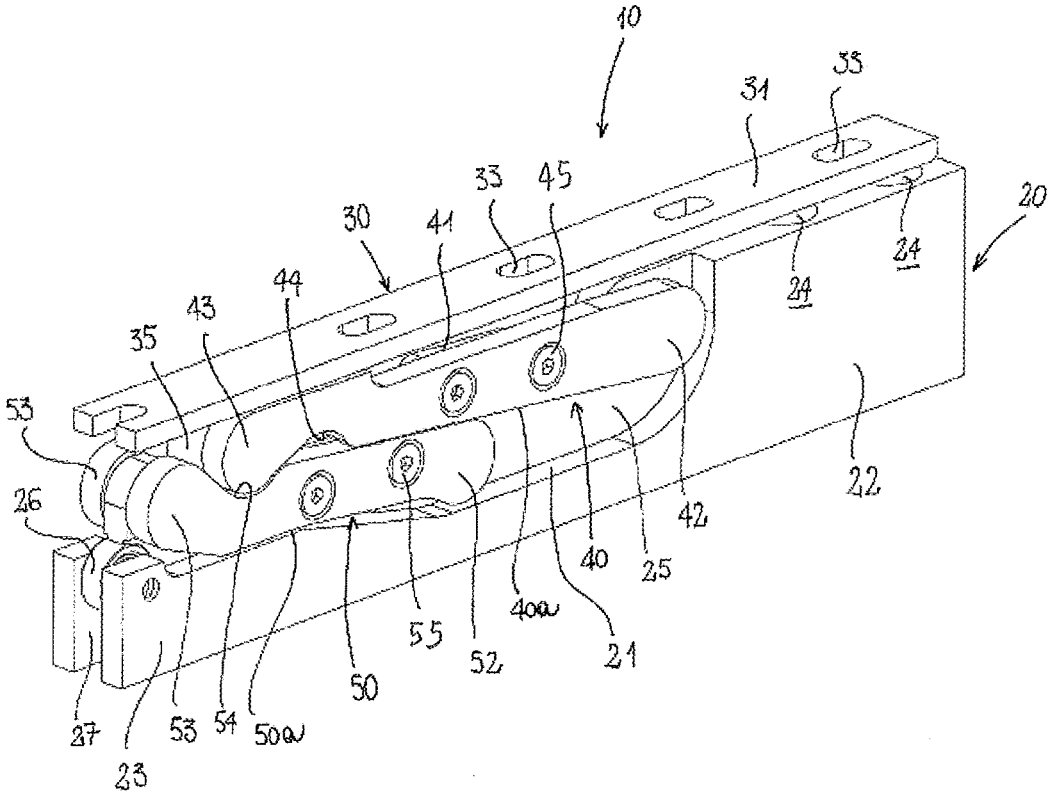
FIG. 4 is a perspective view of the hinge of FIG. 2, shown in closed position.

According to a first embodiment of the invention, illustrated in detail in FIGS. 2-4, the hinge 10 comprises a fixed element 20, a mobile element 30 and a first connecting rod and a second connecting rod, 40 and 50 respectively, hinged between the fixed element 20 and the mobile element 30, so as to obtain an articulated quadrilateral.

In the illustrated embodiment, the first connecting rod 40 and the second connecting rod 50 each consist of a pair of identical rods, 40*a*, 40*b* and 50*a*, 50*b* respectively, which, in use, are parallel and spaced apart. Preferably, between the rods 40*a*, 40*b* and 50*a*, 50*b* a spacer plate 41, 51 is arranged, screwed to them with screws 45, 55, or welded. The double rod configuration of the connecting rods 40, 50 of the articulated quadrilateral gives the hinge 10 good stability during the roto-translation movement of the mobile element 30 with respect to the fixed element 20.

The connecting rods 40, 50, specifically the respective rods 40*a*, 40*b* and 50*a*, 50*b*, have a foot 42, 52 for hinging to the fixed element 20 and a head 43, 53 for hinging to the mobile element 30.

Preferably, the feet 42, 52 and the heads 43, 53 have a rounded shape. Moreover, in each connecting rod 40, 50, close to the head 43, 53, a substantially semi-circular seat 44, 54 is formed. In particular, the seat 44 of the first connecting rod 40 faces towards the second connecting rod 50, and vice-versa.

In completely open position of the hinge 10, shown in FIG. 2, the head of the second connecting rod 50 is housed in the seat 44 of the first connecting rod 40. In greater detail, and with reference to the illustrated embodiment, the heads 53 of each rod 50*a*, 50*b* of the second connecting rod 50 are housed in the respective semi-circular seat 44 of each rod 40*a*, 40*b* of the first connecting rod 40.

Vice-versa, in closed position of the hinge 10, shown in FIG. 4, the head 43 of the first connecting rod 40 is housed in the seat 54 of the second connecting rod 50. In greater detail, and with reference to the illustrated embodiment, in completely open position of the hinge 10, the heads 43 of each rod 40*a*, 40*b* of the first connecting rod 40 are housed in the respective seat 53 of each rod 50*a*, 50*b* of the second connecting rod 50.

Such a configuration of the heads 43, 53 of the connecting rods advantageously makes it possible to obtain the maximum opening of the door 3 and optimal packing of the hinge 10 in closed position.

The fixed element 20 preferably consists of a metal profile in which a cavity 21 is formed, which defines a substantially parallelepiped first end portion 22 and a substantially parallelepiped second end portion 23 having a shorter height than that of the first end portion 22.

At the end portions 22 and 23 of the fixed element, holes 24 are formed for the passage of anchoring elements, for example screws (not shown), of the fixed element 20 to the container body 2 of the showcase 1.

From the cavity 21, preferably centrally thereto, a wall 25 rises up, which acts as a support for the hinging of the feet 42, 52 of the connecting rods 40, 50. In the embodiment shown in FIGS. 2-4, the feet 42, 52 of each rod 40*a*, 40*b*, 50*a*, 50*b* are hinged to the wall 25, on the opposite side with respect to it. Preferably, the wall 25 is made in a single body with the fixed element 20.

The fixed element 20 carries engagement means 26 at the second end portion 23. Preferably, the engagement means comprise a roller 26 housed in a longitudinal cavity 27 formed in the second end portion 23. Of course, it is possible to provide any other type of known engagement means suitable for the purpose. Moreover, without departing from the scope of protection of the invention, the engagement means 26, instead of on the fixed element 20, can be provided on the mobile element 30.

The mobile element 30 comprises a plate 31, preferably metallic, equipped with a plurality of holes 33, preferably slotted, for the passage of means for fixing to the door 3. Of course, instead of screwed, the plate 31 can be associated with the door 3 in another way, for example through welding or gluing.

A wall 35, also preferably metallic, extends from the plate 31 towards the fixed element 20, said wall 35 acting as a support for the hinging of the heads 43, 53 of the connecting rods 40, 50. In the embodiment shown in the figures, the heads 43, 53 of each rod 40*a*, 40*b*, 50*a*, 50*b* are hinged to the wall 35, on the opposite side with respect to it. Preferably, the wall 35 is made in a single body with the mobile element 30.

The wall 35 carries a hook 36, preferably made in a single body with it, with a surface 37 adapted for cooperating in a releasable manner with the engagement means 26, to counteract the movement of the mobile element 30 away from the fixed element 20 when the hinge 10, and therefore the door 3, is in closed position. Of course, without departing from the scope of protection of the invention, the hook 36 can be associated with the fixed element 20 instead of with the mobile element 30. It goes without saying that the shape and size of the hook 36 depend on the particular geometry of the quadrilateral linkage selected.

Figure 5:
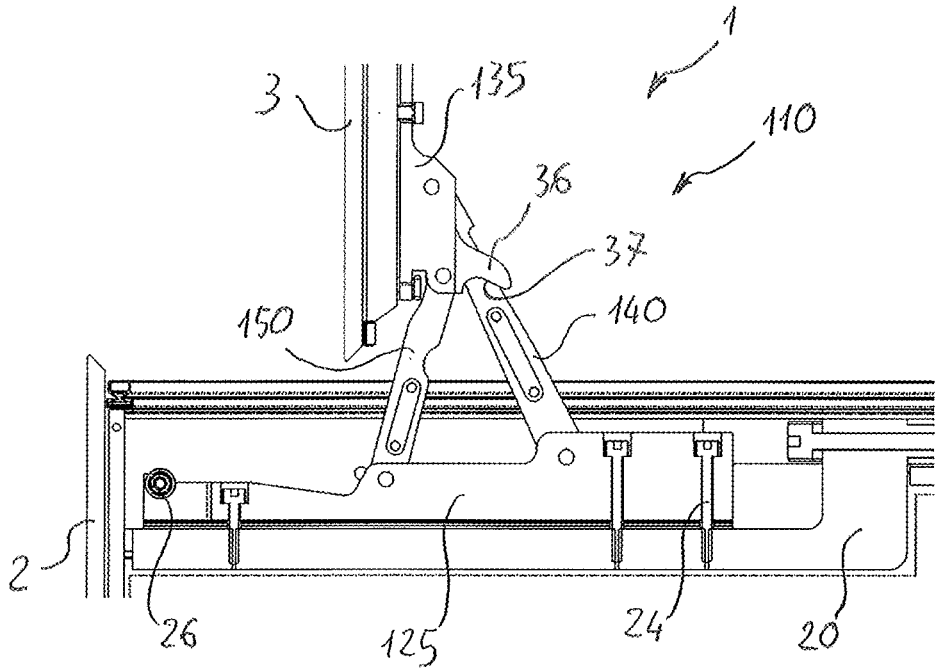
FIG. 5 is a plan view of the hinge of the showcase of FIG. 1, according to a second embodiment of the invention, shown in completely open position.
Figure 6:
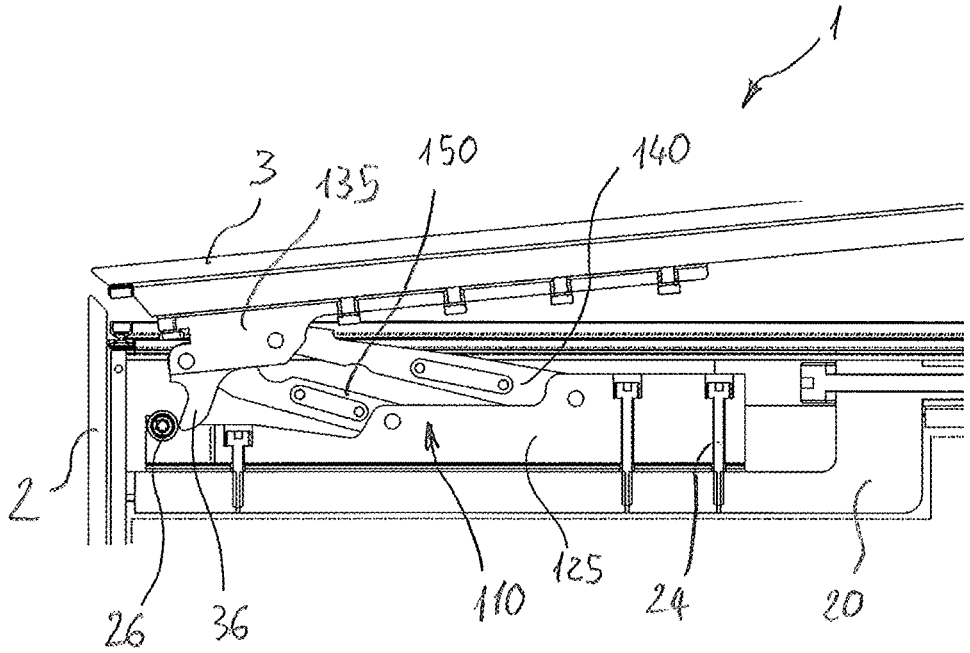
FIG. 6 is a plan view of the hinge of FIG. 5, shown in partially open position.
Figure 7:
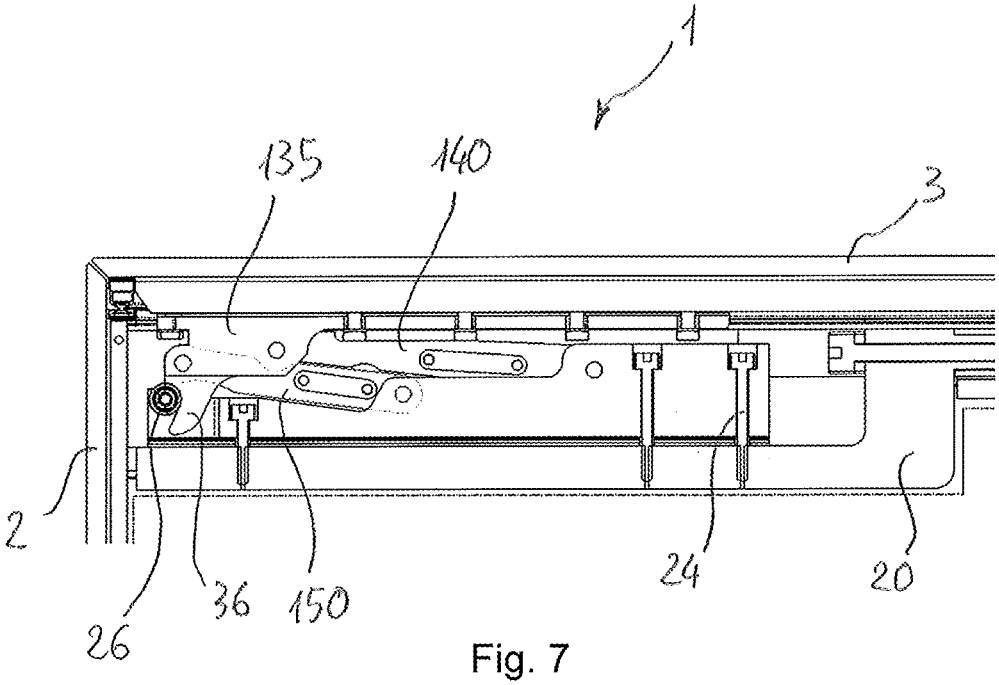
FIG. 7 is a perspective view of the hinge of FIG. 5, shown in closed position.

FIGS. 5-7 show another embodiment of the invention, which comprises a hinge 110; in the hinge 110, elements that are the same as those of the hinge 10 of the embodiment just described are not described here and in the figures they are marked with identical reference numerals, whereas elements that are different but analogous (in structure and/or in operation) are marked by numerals increased by 100.

The hinge 110 differs from the hinge 10 in that the two connecting rods 140 and 150 here are each made with a single rod, whereas instead of the single walls 25 and 35 there are pairs of walls 125 and 135, arranged parallel and spaced apart. The two connecting rods 140 and 150 are thus hinged between the pairs of walls 125 and 135, in a substantially dual manner with respect to the hinge 10. Of course, since the connecting rods 140 and 150 are in a single piece, there are no elements analogous to the spacer plates 41 and 51, as well as to the screws 45 and 55. The single rod configuration of the connecting rods 140, 150 of the articulated quadrilateral also gives the hinge 110 good stability during the roto-translation movement of the mobile element 30 with respect to the fixed element 20, thanks to the double walls 125 and 135.

According to an alternative embodiment not shown in the figures, the hook 36, at the surface 37 thereof adapted for cooperating with the engagement means 26, can have a projection intended to engage in a matching cavity formed in the engagement means 26. This advantageously represents a further impediment to the pure translation of the mobile element 30 with respect to the fixed element 20.

When the hinge 10 (or 110) is closed, the hook 36 is housed in the longitudinal cavity 27 formed in the fixed element 20, engaged with the roller 26. In this way, a possible movement of the mobile element 30 away from the fixed element 20 is prevented, so that the door is perfectly closed on the container body of the showcase. As a result, amongst other things, there is perfect insulation between interior and exterior, which advantageously prevents contaminating agents from entering inside the showcase.

It is clear that modifications, replacements and additions can be brought to the embodiments described above, without however departing from the scope of protection of the invention as defined by the following claims.

The invention claimed is:

1. A museum showcase including a container body, an openable door that closes the container body and at least one hinge, which hinge comprises a fixed element, associated with the container body, a mobile element, associated with the door, a first connecting rod and a second connecting rod hinged between the fixed element and the mobile element so as to obtain an articulated quadrilateral adapted for causing a roto-translation of the mobile element with respect to the fixed element between an open position and a closed position, characterised in that the hinge comprises a hook, associated with one from the fixed element and the mobile element and adapted for cooperating in a releasable manner with engagement means associated with the other from the fixed element and the mobile element, so as to counteract the movement of the mobile element away from the fixed element when the hinge is in closed position, wherein the hook extends from the mobile element and the engagement means comprise a roller fixed to the fixed element.

2. The museum showcase according to claim 1, wherein the roller is housed in a longitudinal cavity formed in an end portion of the fixed element, in which, in closed position of the hinge, the hook is housed.

3. The museum showcase according to claim 1, wherein the hook is formed in a single body with the mobile element.

4. The museum showcase according to claim 1, wherein the first connecting rod and the second connecting rod have a rounded head by which they are hinged to the mobile element and a substantially semi-circular seat close to the head.

5. The museum showcase according to claim 4, wherein the seat of the first connecting rod faces towards the second connecting rod and is adapted for housing the head of the second connecting rod, in completely open position of the hinge.

6. The museum showcase according to claim 4, wherein the seat of the second connecting rod faces towards the first connecting rod and is adapted for housing the head of the first connecting rod, in closed position of the hinge.

7. The museum showcase according to claim 1, wherein the fixed element has a cavity from which a wall projects upwards, hinged to the first connecting rod and to the second connecting rod.

8. The museum showcase according to claim 7, wherein the mobile element comprises a plate from which a wall extends, hinged to the first connecting rod and to the second connecting rod, the hook extending from said wall.

9. The museum showcase according to claim 8, wherein the first connecting rod and the second connecting rod each comprise a pair of rods whose feet are hinged to the wall of the fixed element, on the opposite side with respect to it, and whose heads are hinged to the wall of the mobile element on the opposite side with respect to it.

10. The museum showcase according to claim 1, wherein the fixed element has a cavity from which two parallel and spaced walls projects upwards, hinged to the first connecting rod and to the second connecting rod.

11. The museum showcase according to claim 10, wherein the mobile element comprises a plate from which two parallel and spaced walls extend, hinged to the first connecting rod and to the second connecting rod, the hook extending from said walls.

12. The museum showcase according to claim 11, wherein the first connecting rod and the second connecting rod each comprise a rod whose feet are hinged to the walls of the fixed element, between them, and whose heads are hinged to the walls of the mobile element, between them.

* * * * *